US008806805B2

(12) United States Patent
Melkes et al.

(10) Patent No.: US 8,806,805 B2
(45) Date of Patent: Aug. 19, 2014

(54) BARRIER BOOM IMPLEMENTED AS BENDABLE BOOM OF A VEHICLE BARRIER

(75) Inventors: Mario Melkes, Koppl (AT); Jürgen Schieren, Munich (DE)

(73) Assignee: Skidata AG, Groeig, Salzburg (AT)

( * ) Notice: Subject to any disclaimer, the term of this patent is extended or adjusted under 35 U.S.C. 154(b) by 0 days.

(21) Appl. No.: 13/616,727

(22) Filed: Sep. 14, 2012

(65) Prior Publication Data

US 2013/0133264 A1 May 30, 2013

(30) Foreign Application Priority Data

Nov. 25, 2011 (EP) ..... 11190737

(51) Int. Cl.
*E01F 13/00* (2006.01)

(52) U.S. Cl.
USPC ..... 49/49; 49/9

(58) Field of Classification Search
CPC ..... E01F 13/04; E01F 13/046; E01F 13/048; E01F 13/06
USPC ..... 49/9, 49; 404/6, 9
See application file for complete search history.

(56) References Cited

U.S. PATENT DOCUMENTS

| | | | | |
|---|---|---|---|---|
| 4,897,960 | A * | 2/1990 | Barvinek et al. | 49/49 |
| 6,189,839 | B1 * | 2/2001 | Lemieux | 246/293 |
| 7,818,920 | B2 * | 10/2010 | Causey et al. | 49/49 |
| 2007/0199243 | A1 * | 8/2007 | Youn | 49/49 |

FOREIGN PATENT DOCUMENTS

| | | | | |
|---|---|---|---|---|
| DE | 3719912 | A1 * | 12/1988 | E01F 13/00 |
| EP | 2105534 | A2 | 5/2008 | |
| JP | 2343197 | Y | 10/1999 | |
| JP | 2003193443 | A | 7/2003 | |

OTHER PUBLICATIONS

European Search Report of EP 11 190 737.4, dated May 21, 2012.

* cited by examiner

*Primary Examiner* — Katherine Mitchell
*Assistant Examiner* — Catherine A Kelly
(74) *Attorney, Agent, or Firm* — Karl F. Milde, Jr.; Eckert Seamans Cherin & Mellott, LLC

(57) ABSTRACT

A bendable barrier boom (1) designed to serve as a vehicle barrier, comprises a boom column, a barrier boom (1), and a drive for pivoting the barrier boom (1) between the blocked and the open position. The barrier boom includes a first barrier boom section (2), which is connected to the drive for pivoting the barrier boom (1), and a second barrier boom section (3), which is connected to the first barrier boom section (2) via an articulated joint (4). To maintain the second barrier boom section (3) in the horizontal position, provision is made for a cord (5) arranged in the first barrier boom section (2) parallel to its longitudinal axis that is tightened and clamped around two guide rollers (6, 8). The cord (5) and guide rollers (6, 8) operate to maintain the second boom section in the horizontal position.

13 Claims, 2 Drawing Sheets

BARRIER BOOM IMPLEMENTED AS BENDABLE BOOM OF A VEHICLE BARRIER

BACKGROUND OF THE INVENTION

The invention relates to a bendable barrier boom arrangement designed to serve as a vehicle barrier. This barrier boom arrangement comprises a boom column, a barrier boom and a drive for pivoting the barrier boom between the blocked and the open position.

Barrier booms, which are implemented as bendable booms, are used in particular as parking barriers for controlling the entrance and exit of parking areas, as well as vehicle barriers for operating toll booths. Bendable booms are particularly suitable when the available overall height for the installation of a common, single barrier boom, which is implemented in one piece, is not sufficient. They encompass two barrier boom sections and an articulated joint that is pivoted about a horizontal axis and which connects the two barrier boom sections to one another. One of the two barrier boom sections is connected to the drive for pivoting the barrier boom up and down.

The barrier boom section which is farthest from the supporting barrier column of the vehicle barrier, and which will be referred to hereinbelow as the "second barrier boom section", usually encompasses a substantially horizontal position. In the case of drives which are guided inwardly, this is usually carried out by means of a chain that is arranged parallel to the longitudinal axis of the first barrier boom section in the interior of this boom section, and which is connected to the boom drive. The chain passes around two chain guide rollers, with one chain guide roller arranged coaxially to the pivot axis of the first barrier boom section and the other chain guide roller forming the joint axis of the articulated joint between the two barrier boom sections and connected to the second barrier boom section in a rotation-proof manner. To support the forces which are created by the tensioning of the chain, in the direction parallel to the longitudinal axis of the first barrier boom section, provision is made according to the state of the art for a metal bar or profile, respectively, which extends within the first barrier boom section parallel to its longitudinal axis.

Due to the required chain, barrier booms which are implemented in this manner disadvantageously encompass a relatively high weight, which leads to limitations in the length of the barrier boom that can be obtained, and to a high loading of the drive of the vehicle barrier. Depending on the weight of the chain, a high performance drive is also required, which has a negative impact on the dimensioning and the costs. A further disadvantage of the vehicle barriers which are implemented in this manner is that the production costs are relatively high.

It is known from the state of the art to provide barrier booms of vehicle barriers, for example of parking barriers, with luminous LEDs. A barrier comprising a barrier boom, which is implemented in one piece and which is movably supported on a console between an open and a blocked position, is disclosed in the European Patent EP 2 105 534 A2. The barrier boost is implemented as a light-permeable tube that encloses a strip equipped with light-emitting diodes. Provision is made in the case of this known barrier for this strip, equipped with light-emitting diodes, to extend substantially across the entire length of the barrier boom.

In the bendable barrier booms known from the state of the art, the chain requires a large amount of installation space within the first barrier boom section. As a result, these bendable booms cannot be illuminated by means of LED strips because space for an illumination is not available. The chairs and the metal profile would significantly reduce the space for the strip of light-emitting diodes and impair the light distribution of the LED light.

SUMMARY OF THE INVENTION

The principal object of the present invention is to provide a barrier boom, which is implemented as bendable boom for a vehicle barrier, which comprises a barrier column, a barrier boom and a drive for pivoting the barrier boom between the blocked and open position, and which is light in weight and can be produced in a cost-efficient manner. In addition, the barrier boom according to the invention should be able to extend across a large installation length.

According to the invention, the barrier boom, implemented as a bendable boom for a vehicle barrier, comprises a barrier boom column, a barrier boom, and a drive for pivoting the barrier boom between the blocked and the open position. The barrier boom includes a first barrier boom section, which is connected to the drive for pivoting the barrier boom between the blocked and the open position, and a second barrier boom section, which is connected to the first barrier boom section via an articulated joint and can be pivoted about a horizontal axis.

For maintaining the second barrier boom section in horizontal position, provision is made according to the invention for a cord, for example made of steel or stretch-resistant plastic such a Dyneema®, which is arranged in the first barrier boom section parallel to the longitudinal axis of this section, and which is tightened and clamped around two guide rollers. One guide roller is arranged coaxially to the pivot axis of the first barrier boom section and is connected to a non-rotating shaft, which is connected to the barrier column in a rotation-proof manner. The other guide roller forms the joint axis of the articulated joint between the two barrier boom sections and is connected to the second barrier boom section in a rotation-proof manner.

According to a further development of the present invention, a profile element, which serves as spacer and for increasing the torsional stiffness of the first barrier boom section and for stabilising the first barrier boom section, is arranged in the interior of the first barrier boom section along its longitudinal axis.

According to a still further embodiment of the invention, an LSD band or strip, which preferably comprises a plurality of RGB LEDs and extends parallel to the longitudinal axis of each barrier boom section, is arranged on at least one inner surface of the respective barrier boom section, so that the barrier boom section can be illuminated.

Preferably, provision is in each case made for an LED strip, which is centrally arranged on the inner surface of the lower side of each barrier boom section while extending in the blocked position. The barrier boom sections are preferably made of a translucent material, preferably of a translucent, fiberglass reinforced, polyester resin.

The implementation of the barrier boom as an illuminated bendable boom is made possible by using the cord, which can be made of steel or stretch-resistant plastic, for example, to maintain the second barrier boom section in the horizontal position. Because of this cord, the installation space available for the arrangement of the LSD band is saved as compared to the state of the art. In the case where the barrier boom is not implemented as a barrier boom that can be illuminated, the barrier boom sections can be made of plastic or aluminum.

In the case where a profile element is arranged in the interior of the first barrier boom section along its longitudinal axis and provision is made on at least one inner surface of this barrier boom section for an LED strip, the profile element is preferably made of transparent plastic and optionally encompasses structures which, in case where provision is made for a plurality of LED bands, guide the light that is created in the direction of the arriving vehicles; that is, in the direction toward the side of the barrier boom that faces the arriving vehicles. In the case where provision is made for only one LED band, these structures also direct the light which is created by the LED strip in the direction of the arriving vehicles. As an alternative or in addition to these structures which direct the light toward the arriving vehicles, the surface of the profile element can encompass an amorphous structure that makes it possible to scatter the incident light and thus provide a good illumination of the first barrier boom section.

Due to the design according to the invention, a barrier boom, which is implemented as bendable boom for a vehicle barrier, provides the bendable boom functionality without the necessity of a chain. Dee to the use of a cord, for example made of steel or stretch-resistant plastic, the barrier boom is lighter than the bendable booms known from the state of the art, whereby the production costs are reduced significantly due to the material savings. The light construction further reduces the loading of the drive of the vehicle barrier. In addition, a large installation length can be obtained due to the light construction in an advantageous manner.

Due to the use of the cord, a bendable boom can be dimensioned in the manner of a prior art bendable boom and yet provide for an illumination from the inside by means of LED bands. The boom can furthermore be implemented according to the design of the present invention. The optional use of the profile element made of transparent plastic increases the torsional stiffness and leads to an optimal illumination and light scattering.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
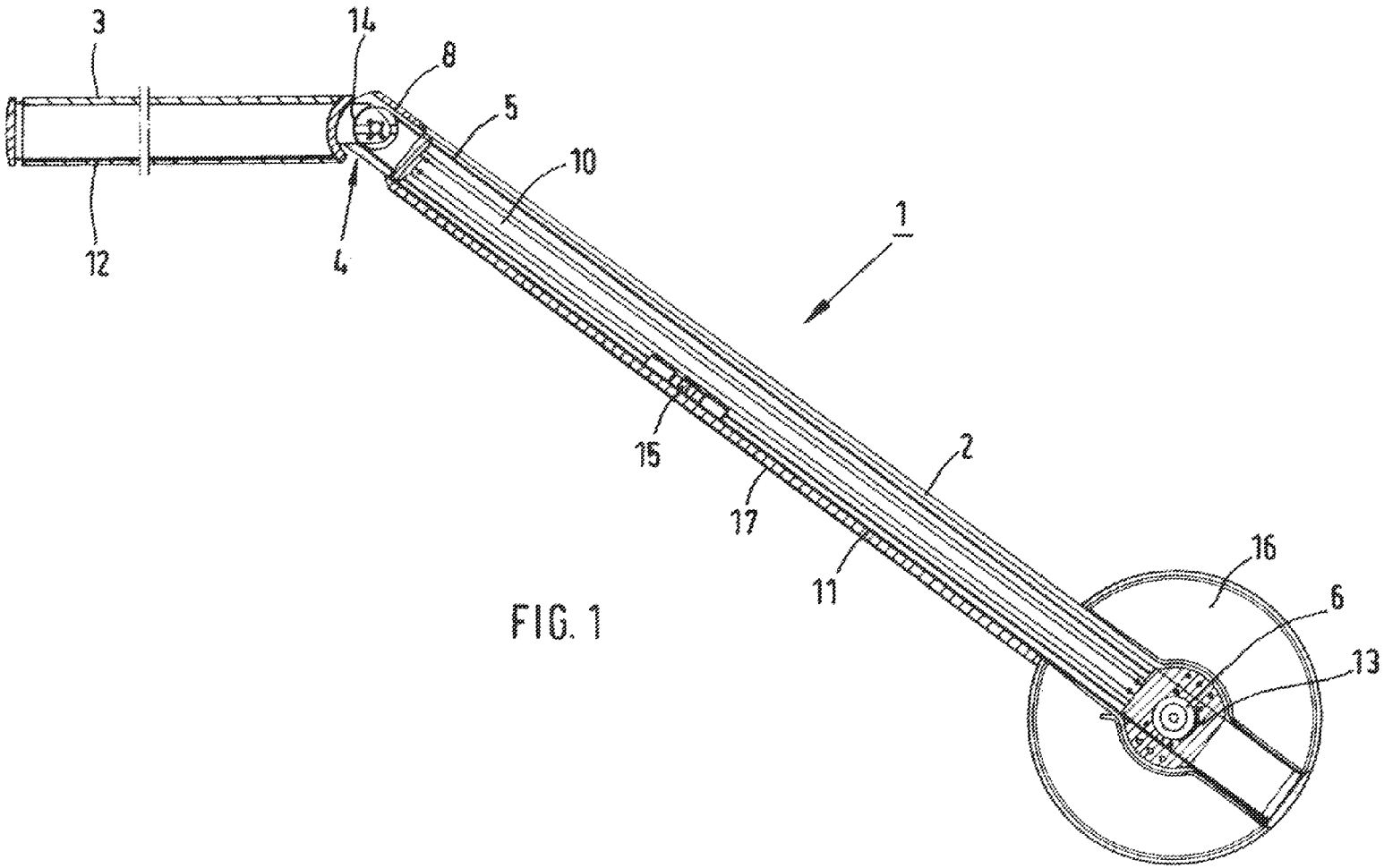
FIG. 1 shows a sectional view of a bendable boom according to the invention, which can be illuminated from within.

The preferred embodiments of the present invention will now be described with reference to FIGS. 1 and 2 of the drawings. Identical elements in the two figures are designated with the same reference numerals.

FIG. 1 illustrates a barrier boom 1, which is implemented as a bendable boom, designed to serve as a vehicle barrier, that can be illuminated by LEDs. The barrier boom 1 comprises a first barrier boom section 2, which is connected to the drive for pivoting the barrier boom 1 between the blocked and the open position, and a second barrier boom section 3, which is connected to the first barrier boom section 2 via a pivot or articulated joint 4 having a horizontal pivot axis.

To maintain, the second barrier boom section 3 in horizontal position, provision is made for a cord 5, which is arranged in the first barrier boom section 2 parallel to the longitudinal axis of this section 2 and which is tightened and clamped around two cord guide rollers 6, 8. To increase the friction between the cord and the cord guide rollers, the cord can optionally be wound around the guide rollers at least once.

Figure 2:
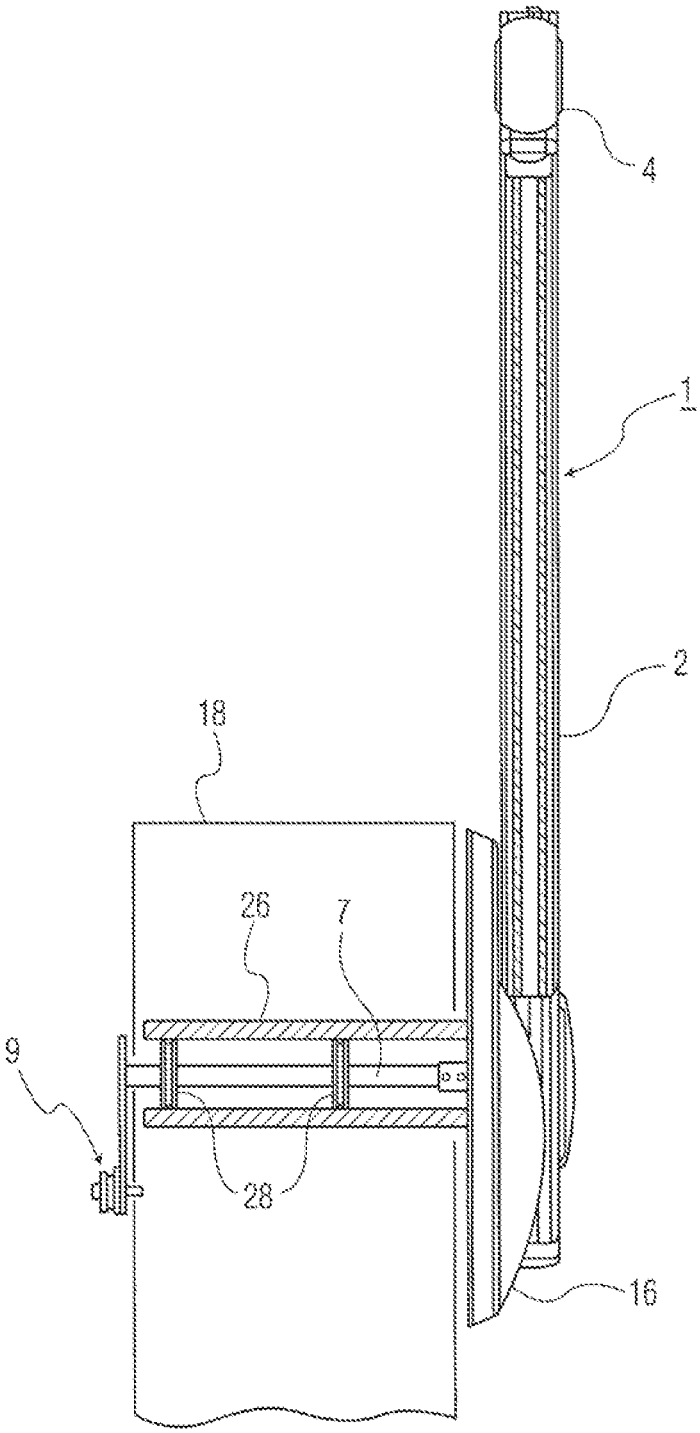
FIG. 2 shows a top view of the bendable boom of FIG. 1 to illustrate the connection of the bendable boom to the barrier column for maintaining the second barrier boom section in a horizontal position.

With reference to FIGS. 1 and 2, a cord guide roller 6 is arranged coaxially with respect to the pivot axis of the first barrier boom section 2 and is connected to a non-rotating shaft 7. The shaft 7 is connected to the barrier boom column 18 in a rotation-proof manner by element 9 to maintain the horizontal position of the second barrier boom section 3. The other cord guide roller 8 forms the joint axis of the articulated joint 4 between the two barrier boom sections 2, 3 and is connected to the second barrier boom section 3 in a rotation-proof manner.

As shown in FIG. 2 the barrier boom 1 is mounted on a boom column 18. An electrical drive mechanism pivots the the lower boom section 2 about a horizontal pivot axis between a transversely horizontal, blocking position and an upright, open position by rotating a hollow barrier boom shaft 26 about the pivot axis. The boom shaft 26 is connected to and rotates a head disk 16 that supports the boom section 2. The shaft 26 is supported on the shaft 7 by bearings 28.

In a further development of the present invention, the shaft 7, which is connected to the barrier column, is implemented so as to be rotatable and lockable in a predetermined angular range, making possible an adjustment of the incline of the second barrier boom section 3 relative to the horizontal position.

With reference to FIG. 1, a profile element 10 of transparent plastic, which serves as spacer and for increasing the torsional stiffness of the first barrier boom section and thus stabilizing the first barrier boom section, is arranged in the interior of the first barrier boom section 2 along the longitudinal axis, without preventing the transmission of the light that is created by an LED strip 11, within this boom section 2. The surface of the profile element 10 has an amorphous structure that provides for a scattering of the light created by the LED strip 11, and thus provides for a good illumination of the first barrier boom section 2.

As can be gathered from FIG. 1, an LED strip 11, 12 is in each case centrally arranged parallel to the longitudinal axes of the barrier boom sections 2, 3 on the inner surface of the lower sides of these barrier boom sections 2, 3 when in the blocked position. Provision is made on the cord guide rollers 6, 8 for a flexible cable 13, 14 for the supply of power to the LED strips 11, 12.

An overload coupling 9 is connected to the non-rotating shaft 7, which releases when a predetermined force is exceeded so as to prevent damage to the components of the barrier boom 1.

To longitudinally adjust the length of the cord 5, provision is made for a turnbuckle 15. To protect both the barrier boom sections 2, 3 and the vehicles, provision can optionally further be made for a protective strip 17, preferably made of plastic and preferably reflective.

In the embodiment shown, the first barrier boom section 2 is connected to a barrier head disk 16 on the end facing the barrier column in a rotation-proof manner. This barrier head disk 16 is connected to the electrically driven barrier boom shaft in a rotation-proof manner in the area of the barrier head of the barrier column. The end of the first barrier boom section 2, which extends toward the barrier column, is positively accommodated in the barrier head disk 16 and connected to the barrier head disk 16 by means of non-positive connecting elements with a break-off function in the direction parallel to the pivot axis of the barrier boom 1. This creates a predetermined breaking point which is integrated into the connecting elements between the barrier head disk 16 and the first barrier boom section 2.

The non-rotating shaft 7, that is connected to the barrier column, is thereby guided through the barrier boom shaft which is implemented as a hollow shaft.

There has thus been shown and described a novel barrier boom implemented as bendable boom of a vehicle barrier which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a bendable barrier boom adapted to serve as a vehicle barrier, comprising a boom column, barrier boom, and a drive for pivoting the barrier boom about a horizontal pivot axis between a blocking and an open position, said harrier boom including a first barrier boom section, connected to the drive for pivoting the barrier boom, and a second barrier boom section, connected to the first barrier boom section via an articulated joint that pivots about a second horizontal axis parallel to the pivot axis, the improvement comprising an arrangement for maintaining the second harrier boom section in a horizontal position, said arrangement including cord, which is arranged in the first barrier boom section parallel to a longitudinal axis thereof and which tighten and clamped around two guide rollers; wherein one guide roller is arranged coaxially with respect to said pivot axis and is rigidly connected to a co-axial, non-rotating shaft which, in turn, connected to the boom column; wherein the other guide roller forms a joint axis of the articulated joint between the two barrier boom sections, said other guide roller being rotatable with respect to the first boom section and non-rotatable with respect to the second barrier boom section; wherein one end of the first barrier boom section is rigidly connected to a barrier head disk; wherein said barrier head disk is rigidly connected to an electrically driven, hollow barrier boom shaft extending along the pivot axis; wherein the end of the first barrier boom section which faces the boom column is positively accommodated in the barrier head disk; wherein the first barrier boom section is connected to the barrier head disk by means of non-positive connecting elements having a break-off function in a direction parallel to the pivot axis, thereby providing a predetermined breaking point, which is integrated into the connecting elements between the barrier head disk and the first barrier boom section; and wherein the non-rotating shaft which is connected to the boom column, extends coaxially through the barrier boom shaft.

2. The barrier boom according to claim 1, wherein a profile element, which serves for increasing the torsional stiffness of the first barrier boom section and for stabilizing the first barrier boom section, is arranged in the interior the first barrier boom section along the longitudinal axis thereof.

3. The barrier boom according to claim 1, wherein at least one LED strip is arranged on at least one inner surface of each barrier boom section, parallel to a longitudinal axis of each respective boom section, and wherein the boom sections are made of a translucent material.

4. A barrier boos according to claim 3, wherein the at least one LED strip is in each case centrally arranged on the inner surface of the lower side of the respective boom section, parallel to the longitudinal axis of the respective boom section.

5. The barrier boom according to claim 3, further comprising a profile element arranged in the interior of the first barrier boom section along its longitudinal axis, said profile element being made of a transparent plastic.

6. The barrier boom according to claim 5, wherein the surface of the profile element is configured to provide for scattering of the light created by the at least one LED strip and which thus improves illumination of the first barrier boom section.

7. The barrier boom according to claim 5, wherein the profile element includes structures which, in the event that the at least one LED strip comprises a plurality of LED strips, guide light created by at least one of the plurality of LED strips in the direction toward the side of the barrier boom that faces arriving vehicles, and wherein, when the at least one LED strip comprises a single LED strip, the structures reflect light created by the LED strip toward the side of the barrier boom that faces arrivinq vehicles.

8. The barrier boom according to claim 1, further comprising an overload coupling, connected to the non-rotating shaft, which releases when a predetermined externally applied force is exceeded, thereby to prevent damage to components of the barrier boom.

9. The barrier boom according to claim 1, wherein the angular position of the non-rotating shaft with respect to the boom column is selectable and lockable within a predetermined angular range, thereby to adjust the incline of the second barrier boom section relative to the horizontal.

10. The barrier boom according t claim 3, wherein provision is made on the cord guide rollers for a flexible cable for power supply of the at least one LED strip.

11. The barrier boom according to claim 1, further comprising a turnbuckle for longitudinally adjusting the length of the cord.

12. The barrier boom according to claim 1, wherein the cord is made of steel.

13. The barrier boom according to claim 1, wherein the cord is made of stretch-resistant plastic.

* * * * *